United States Patent [19]

Goetti et al.

[11] 3,965,663

[45] June 29, 1976

[54] SPUN YARN

[75] Inventors: Hans Goetti; Anton Mittler; Hermann Forrer, all of Burglen, Switzerland

[73] Assignee: Kammgarnspinnerei Burglen, Burglen, Switzerland

[22] Filed: Sept. 18, 1974

[21] Appl. No.: 507,298

Related U.S. Application Data

[63] Continuation-in-part of Ser. No. 300,993, Oct. 26, 1972, abandoned.

[30] Foreign Application Priority Data

Nov. 1, 1971 Switzerland ..... 15905/71

[52] U.S. Cl. ..... 57/140 BY; 57/157 R

[51] Int. Cl.[2] ..... D02G 3/04

[58] Field of Search ..... 57/156, 140 R, 157 R, 57/140 BY, 139; 19/145.5, 155; 28/72.2 R

[56] References Cited

UNITED STATES PATENTS

| | | | |
|---|---|---|---|
| 2,867,077 | 1/1959 | Wilkie | 57/157 R |
| 2,965,139 | 12/1960 | Thier | 19/145.5 X |
| 3,128,507 | 4/1964 | Pearson | 19/145.5 X |
| 3,224,181 | 12/1965 | Johnson | 57/156 |
| 3,251,097 | 5/1966 | Faw et al. | 19/145.5 |
| 3,412,548 | 11/1968 | Poltorak | 57/156 |
| 3,595,721 | 7/1971 | Hamano et al. | 28/72.2 X |

*Primary Examiner*—John Petrakes
*Attorney, Agent, or Firm*—Michael J. Striker

[57] ABSTRACT

A spun yarn includes synthetic plastic staple fibers of at least three different titers. One of these titers is a medium titer which is within a range of about 6 microns of the average titer of the synthetic plastic fibers in the yarn. Another titer is a fine titer which is at most about 15 microns less than the average titer of the synthetic plastic fibers in the yarn. The third titer is a coarse titer which is at most about 15 microns in excess of the average titer of the synthetic plastic fibers in the yarn. The fibers of medium titer constitute a minimum of about two-thirds of the weight of the synthetic plastic fibers in the yarn. The selection of the titers in this manner enables a spun yarn of synthetic plastic fibers to be obtained which, to the touch, feels like a yarn made of natural fibers.

7 Claims, 9 Drawing Figures

SPUN YARN

CROSS-REFERENCE TO RELATED APPLICATION

This is a continuation-in-part of application Ser. No. 300,993 filed Oct. 26, 1972, now abandoned.

BACKGROUND OF THE INVENTION

The present invention relates generally to yarns, and, more particularly, to novel spun yarns.

The manufacture of spun yarns from synthetic plastic fibers is well established. It is also well known that, in general, the industry attempts, in the selection and conversion of synthetic plastic fibers into such spun yarns, to match as closely as possible the "touch" of similar spun yarns which are made from natural fibers such as wool, cotton, linen or other vegetable or animal fibers. This is desirable because, as a general rule, the "touch", that is, the feel of spun yarns made from synthetic plastic fibers when contacted by the skin of the user, is not as pleasing as the "touch" of similar spun yarns made from natural fibers.

Heretofore, this desired aim has not been achieved, or, at least, has not been satisfactorily achieved. The synthetic plastic fibers, even if different types of fibers of fibers having different characteristics were mixed together, did not produce a touch which was felt to be as pleasing as that afforded by yarns made from natural fibers. Industry has attempted to alleviate the problem by admixing the synthetic plastic fibers with natural fibers, that is, fibers of vegetable or animal origin, In many instances this did, indeed, lead to improvements in the touch of the finished fabric, but investigations showed that it was not even remotely possible to entirely match the touch of fabrics made from natural fibers alone. Moreover, the manufacturing costs and various characteristics of yarns made of such mixtures of natural and synthetic fibers have been found to be disadvantageously influenced as opposed to yarns made only of natural or only of synthetic fibers.

SUMMARY OF THE INVENTION

It is a general object of the present invention to avoid the disadvantages of the prior art.

More particularly, it is an object of the present invention to provide for novel spun yarns which may consist wholly or predominantly of synthetic plastic fibers and yet have a touch which at least approximates that of spun yarns made only of natural fibers.

In pursuance of these objects, and of others which will become apparent hereafter, one feature of the invention resides, as a novel article of manufacture, in spun yarns which include synthetic plastic staple fibers of at least three different titers. One of these titers is a medium titer which is preferably within a range of about 6 microns of the average titer of the synthetic plastic fibers in the yarn. Another of the titers is a fine titer which is preferably at most about 15 microns less that the average titer of the synthetic plastic fibers in the yarn. A third titer is a coarse titer which is preferably at most about 15 microns in excess of the average titer of the synthetic plastic fibers in the yarn. The fibers of medium titer advantageously constitute a minimum of about two-thirds of the weight of the synthetic plastic fibers in the yarn.

The invention is based upon the not previously understood fact that the desired effect, that is, the desired touch or feel of the spun yarn, can be obtained in the production of spun yarns from synthetic plastic staple fibers only be admixing different types of such staple fibers together. The reference to different "types" here is not to different materials or characteristics but to the fact that each "type" has a different titer, that is, a different diameter or thickness. It is not possible, however, to merely admix fibers of different titer but it is necessary to adhere to a particular formula for establishing the mixture, namely, to select the percentage relationship of fibers in the mix in such a manner that the mix will contain more fibers of medium titer than of coarse and fine titer, respectively. Of course, the mix may contain fibers whose titer lies between the medium and the coarse titer, on the one hand, and between the medium and the fine titer, on the other hand, but these would be present proportionately, that is, there would be more of them than the coarse or fine titer fibers but fewer of them than the medium titer fibers. In other words, if fibers of a given titer intermediate the medium and coarse titers are present, there would be more of these fibers of given titer than the fibers of coarse titer but less of the fibers of given titer than the fibers of medium titer. The same applies for fibers of a given titer intermediate the medium and fine titers.

It is advantageous if at least three continuous tows or converter slivers, each composed of fibers of a particular titer, are admixed with one another and spun together. This admixture may be effected during the feeding of the tows to a converter wherein they are subdivided, e.g. severed or cut to predetermined lengths so as to be converted to slivers, that is, the admixture may be effected prior to conversion of the tows to slivers. On the other hand, the admixture may be effected during the feeding of the slivers to a gill box wherein they are drawn or gilled, that is, the admixture may be effected prior to drawing of the slivers if desired. It is also possible to effect the admixture during the feeding of the tops obtained from the slivers to the mixing passages of a pre-spinning device. It will be appreciated that these represent only some of the possibilities in accordance with the invention and that other possibilities may exist for effecting the admixture.

It is particularly advantageous, in accordance with the present invention, if the distribution of the titer of fibers in the mix is effected in accordance with a conventional bell-shaped frequency distribution curve corresponding to that of wool, that is, a bell curve indicating the percentages of fiber titer in wool fibers. This distribution may be changed as desired in order to accommodate the spun yarn to the touch of yarns made from various different natural fibers other than wool and it is, of course, also possible to admix natural fibers (of vegetable or plant origin) with the synthetic plastic fibers in the production of the spun yarn.

It is further advantageous if the fibers are not only of different titer, but are also of different staple lengths. The reason is that this permits an even closer approximation to the touch of products made from natural fibers since the latter also exhibit different staple lengths.

A spun yarn made according to the present invention will have at least three different types of synthetic plastic staple fibers having coarse, medium and fine titer, respectively, and the quantity of fibers having medium titer in the material will be greater than that of the fibers having coarse titer and fine titer, respectively.

The result achieved with the present invention is a spun yarn whose touch approximates quite closely the touch of a spun yarn made from natural fibers; depending upon the particular fiber mixture, the touch of spun yarns made from different natural fibers can be approximated.

It is clear, of course, that the fiber mix may be chosen not only according to the different titer and the distribution of fibers of different titer, but also in accordance with other desired characteristics, that is, different synthetic plastic materials may be represented such as synthetic plastic materials having different characteristics or the like, in order to obtain a fabric whose finished characteristics (touch) correspond to those which it is desired to obtain. Synthetic plastic fibers may, for instance, be of the type extruded from nozzles of different size or different cross section, and they may have been differentially stretched or oriented. The particular mix will, of course, depend upon the particular characteristics which it is desired to obtain for the finished spun yarn, which may be determined by reasonably simple experimentation but always keeping in mind the requirement according to the present invention as to the proportion of fibers of different titer in the mix.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

A general outline of the invention will first be presented with respect to FIGS. 1–4.

Figure 1:
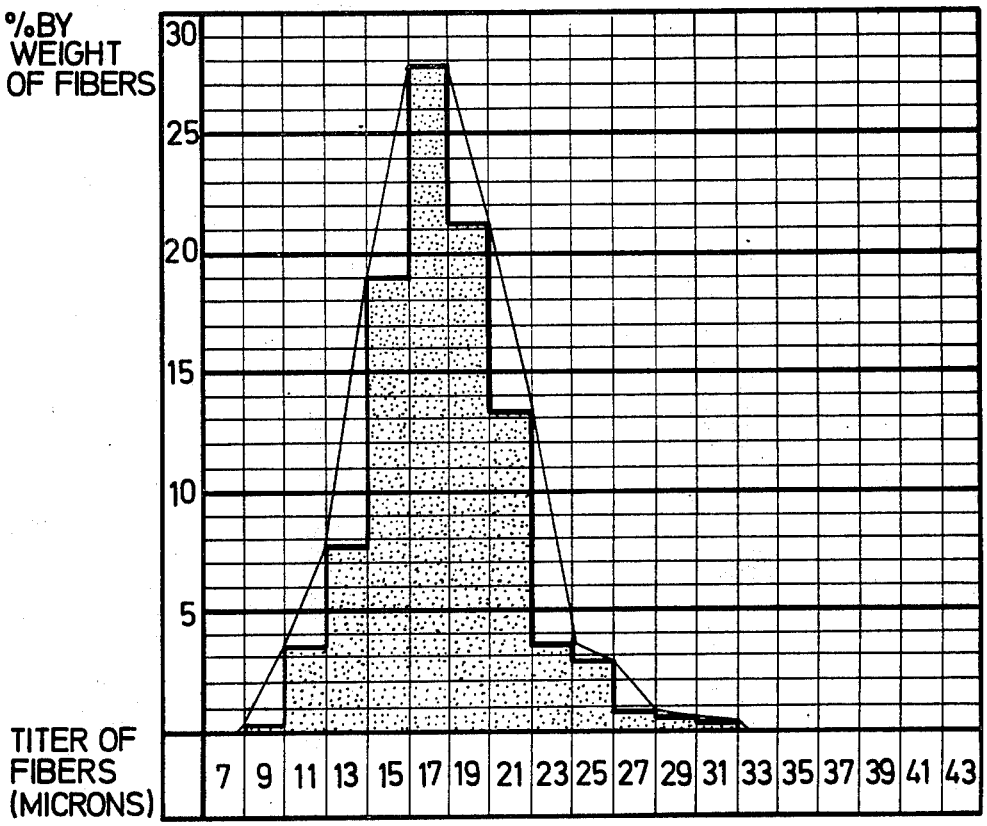
FIGS. 1–4 are diagrams illustrating various distributions of synthetic plastic fibers of different titer in a spun yarn or fiber mix according to the invention.

Reference to FIG. 1 will show that the graph indicates the percentage range (in weight%) of synthetic plastic staple fibers in the mix or the spun yarn, as well as the titer which is expressed in microns. The bell-shaped distribution curve has been shown for purposes of orientation, and it will be seen that for the extreme titer values of 9 and 31 microns for fibers in the mix, less than 1% by weight of fibers will be present. The mix further contains fibers, in the amount of less than 1% by weight, having a titer of between 27 and 29 microns. The following titer values of 11 microns on the one hand and 25 microns on the other hand are slightly higher but still represented by less than 4% by weight in the total mix. It is clear from an examination of the drawing that the percentage range increases as the titer size tends towards the median value, with the values between 13 and 21 microns representing the largest percentage of the total fiber mix. In the illustrated embodiment, the fibers having a titer of 17 microns amount to almost 28% by weight of the mix.

By way of example, there follows hereafter a table corresponding to FIG. 1 and giving the distribution of titers of synthetic plastic fibers in a band, that is, a spun yarn in form of a band, which is made from these fibers:

| | | | |
|---|---|---|---|
| 9–10μ= | 0.2% | 21–22μ= | 13.3% |
| 11–12μ= | 3.5% | 23–24μ= | 3.4% |
| 13–14μ= | 7.5% | 25–26μ= | 2.7% |
| 15–16μ= | 19.0% | 27–28μ= | 0.9% |
| 17–18μ= | 27.7% | 29–30μ= | 0.5% |
| 19–20μ= | 21.1% | 31–32μ= | 0.2% |
| | | | 100.0% |

The term "touch" may, in one sense, be considered as representing the pleasantness of the sensation of a product to the skin. In the first instance, however, it is intended to represent the sense of touch which is experienced when sampling a textile product by touching it with the hand. It is selfunderstood, of course, that the hardness of coarseness of a product, as well as the pliability or softness thereof, may be determined in this manner. For example, the "touch" of wool with its coarse outer surface is obviously different from that of cotton.

The touch of a spun yarn according to the invention may be predetermined by adjusting the titer distribution thereof so as to conform to the titer distribution of a natural product which is to be copied, and also by adjusting the fineness of the spin of the yarn to that of the natural product. The exemplary distribution of FIG. 1 corresponds to a Merino wool having a fineness designated by "U.S. Wood Grade ASTM 80s" (70/1 metric count). Thus, by adjusting the titer distribution of the synthetic fibers to the titer distribution in a specific natural product, a close approximation of the touch of this natural product by the spun yarn in accordance with the invention may be obtained. In this connection, the characteristics of the synthetic fibers used is of secondary importance in obtaining a desired effect and the desired effect is due, at least in the main, to the titer distribution.

Figure 2:
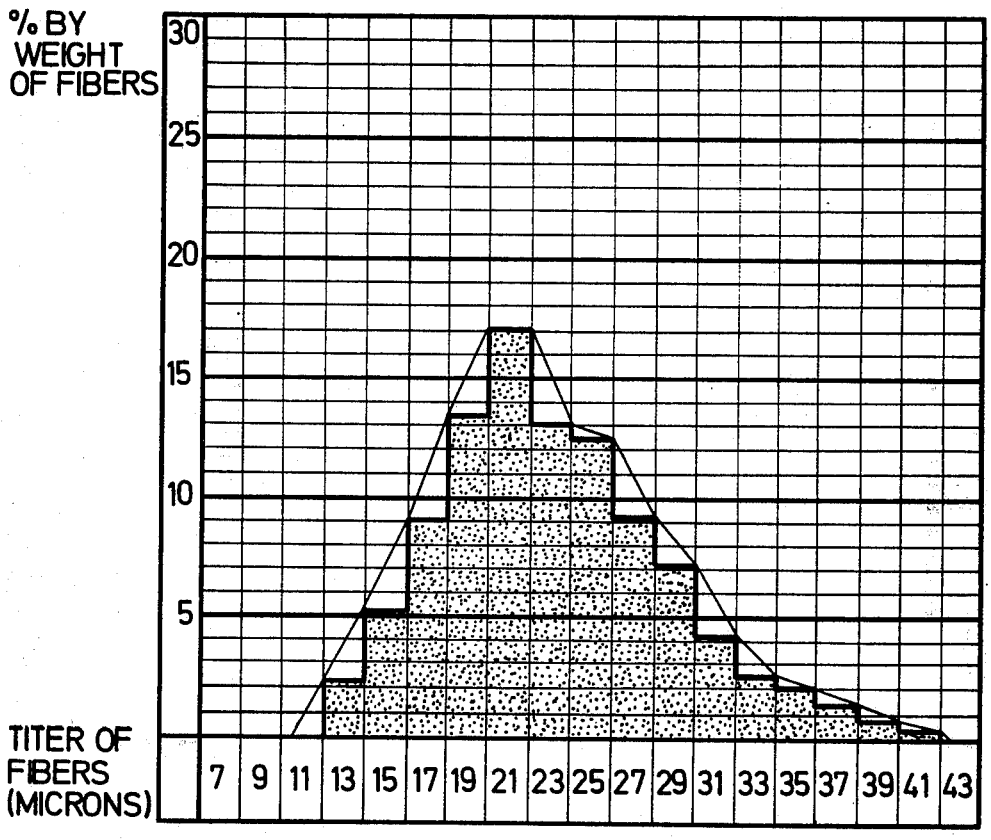

FIG. 2 is similar to FIG. 1 and shows another titer distribution for a fiber mix according to the invention. The following table gives the distribution of titers of synthetic plastic fibers for FIG. 2:

| | | | |
|---|---|---|---|
| 12–13μ= | 2.2% | 26–27μ= | 9.1% |
| 14–15μ= | 5.0% | 28–29μ= | 7.1% |
| 16–17μ= | 9.1% | 30–31 μ= | 4.2% |
| 18–19μ= | 13.1% | 32–33μ= | 2.5% |
| 20–21μ= | 17.1% | 34–35μ= | 2.0% |
| 22–23μ= | 13.0% | 36–37μ= | 1.2% |
| 24–25μ= | 12.7% | 38–39μ= | 0.7% |
| | | 40–41μ= | 1.0% |
| | | | 100.0% |

It will again be seen that the weight percent of the fibers in the mix increases with increasing titer size towards the median value and then decreases with increasing titer size beyond the median value. In the embodiment of FIG. 2, the fibers having a titer of 21 microns are present in the largest amount and constitute somewhat over 17% by weight of the mix. This titer distribution corresponds to "U.S. Grade ASTM 62s" (36/1 metric count).

Figure 3:
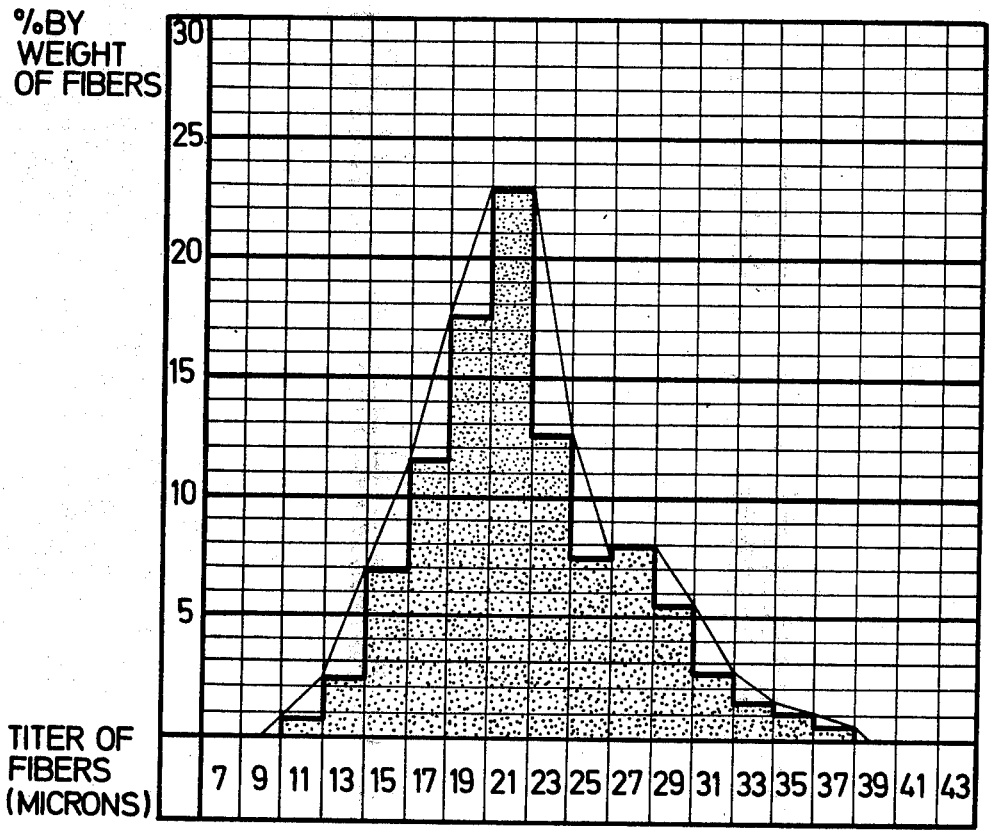

Still another titer distribution for a fiber mix in accordance with the invention is illustrated in FIG. 3 which is similar to FIGS. 1 and 2. Here, the titer distribution is as set forth in the following table:

| | | | |
|---|---|---|---|
| 10–11μ= | 0.8% | 24–25μ= | 7.3% |
| 12–13μ= | 2.2% | 26–27μ= | 7.5% |
| 14–15μ= | 6.9% | 28–29μ= | 5.5% |

-continued

| | | | |
|---|---|---|---|
| 16–17μ= | 11.6% | 30–31μ= | 2.8% |
| 18–19μ= | 17.8% | 32–33μ= | 1.2% |
| 20–21μ= | 22.6% | 34–35μ= | 0.7% |
| 22–23μ= | 12.8% | 36–37μ= | 0.3% |
| | | | 100.0% |

In this embodiment, the fibers having a titer of 21 microns are those which are present in the greatest quantity, namely, 22.6% by weight. As before, the weight percent of fibers in the mix decreases with decreasing titer size away from the median value and also decreases with increasing titer size away from the median value. The titer distribution of FIG. 3 corresponds to "U.S. Grade ASTM 64s" (40/1 metric count).

Figure 4:
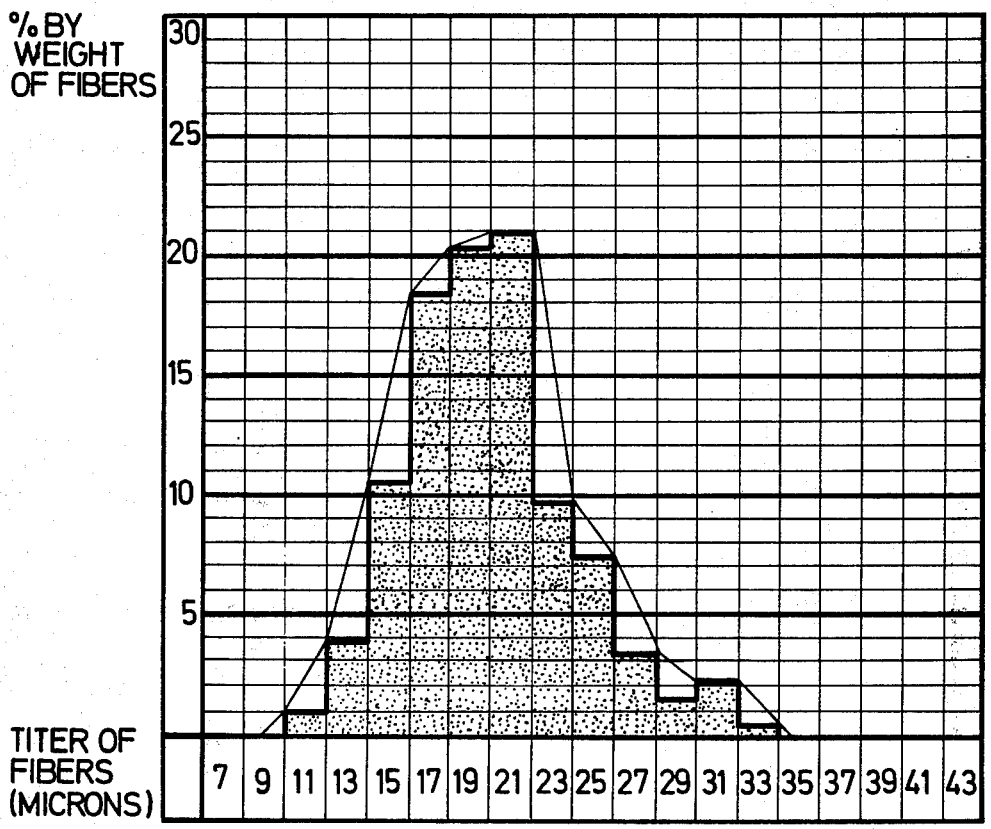

FIG. 4, which is similar to the preceding FIGURES, shows an additional titer distribution for a fiber mix according to the invention. This titer distribution is given in the table which follows:

| | | | |
|---|---|---|---|
| 10–11μ = | 2.0% | 22–23μ = | 9.9% |
| 12–13μ = | 3.9% | 24–25μ = | 7.2% |
| 14–15μ = | 10.5% | 26–27μ = | 3.2% |
| 16–17μ = | 18.2% | 28–29μ = | 1.5% |
| 18–19μ = | 20.1% | 30–31μ = | 2.1% |
| 20–21μ = | 20.9% | 32–33μ = | 0.5% |
| | | | 100.0% |

In the embodiment of FIG. 4, the fibers present in the largest amount are those having a titer of 21 microns which constitute nearly 21% by weight of the mix although fibers having a titer of 19 microns are present in almost the same amount. This titer distribution corresponds to "U.S. Grade ASTM 70s" (54/1 metric count). As was true for the preceding embodiments, the weight percent of fibers increases with increasing titer towards the median value and decreases with increasing titer beyond the median value. The minor departures from this rule observed in the embodiments of FIGS. 2–4 (titers of 39 and 41 microns in FIG. 2; titers of 25 and 27 microns in FIG. 3; titers of 29 and 31 microns in FIG. 4) are of no particular significance, especially in view of their small magnitude.

It will be seen that the weight percent of fibers of any given titer intermediate the finest and the median titers is smaller than the weight percent of the fibers of median titer and greater than the weight of the fibers of finest titer (Disregarding, of course, such minor variations as just outlined) . . . Similarly, the weight percent of fibers of any given titer intermediate the coarsest and median titers is smaller than the weight percent of the fibers of median titer and greater than the weight percent of the fibers of coarsest titer.

The foregoing description with reference to FIGS. 1–4 has served to illustrate generally the titer distribution according to the invention. However, in further accordance with the invention, and as indicated earlier, it is advantageous for the fiber mix or the spun yarn to be constituted in such a manner that the following conditions are satisfied: (a) The synthetic plastic staple fibers of medium titer have a titer within a range of about 6 microns of the average titer or fineness of the synthetic plastic fibers in the fiber mix or spun yarn. In other words, the medium fibers favorably have a titer between about 6 microns less than the average titer and about 6 microns more than the average titer. (b) The synthetic plastic staple fibers of fine titer have a titer which is at most about 15 microns less than the average titer of the synthetic plastic fibers in the fiber mix or spun yarn. (c) The synthetic plastic staple fibers of coarse titer have a titer which is at most about 15 microns in excess of the average titer of the synthetic plastic fibers in the fiber mix or spun yarn. (d) The fibers of medium titer constitute a minimum of about two-thirds of the weight of the synthetic plastic fibers in the fiber mix or spun yarn.

It may be mentioned again that the average titer referred to herein relates to the average of the titers of the synthetic plastic fibers in the fiber mix or spun yarn. The average titer of the synthetic plastic fibers is calculated as a weighted arithmetic average, that is, an arithmetic average which takes into account the proportion of the fibers of a particular titer which is present.

The preferred embodiment of the invention wherein the four conditions outlined above are satisfied will be illustrated with reference to FIGS. 5–8. These FIGURES are similar to FIGS. 1–4 but show additional titer distributions according to the invention.

Figure 5:
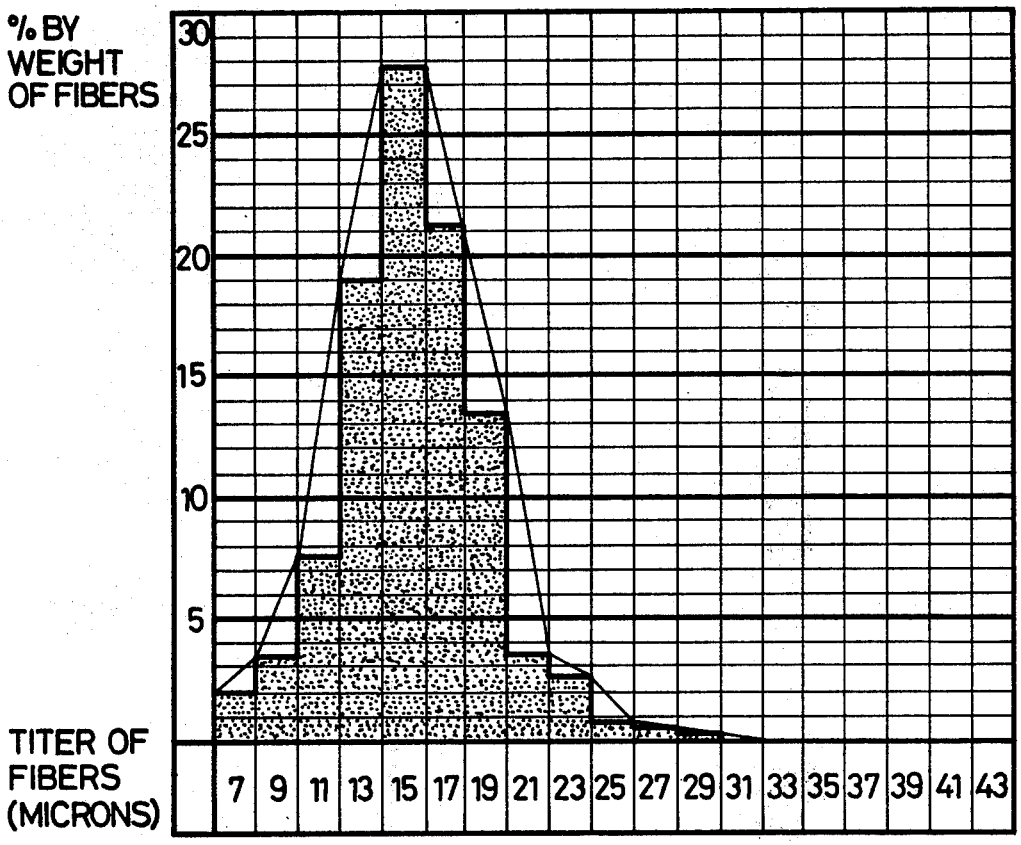
FIGS. 5–8 are similar to FIGS. 1–4 and show further distributions in accordance with the invention.

With regard first to FIG. 5, the following table sets forth the titer distribution illustrated therein:

| | | | |
|---|---|---|---|
| 7– 8μ= | 2.0% | 19–20μ= | 13.3% |
| 9–10μ= | 3.5% | 21–22μ= | 3.4% |
| 11–12μ= | 7.5% | 23–24μ= | 2.7% |
| 13–14μ= | 19.0% | 25–26μ= | 0.9% |
| 15–16μ= | 27.7% | 27–28μ= | 0.5% |
| 17–18μ= | 21.1% | 29–30μ= | 0.2% |
| | | | 100.0% |

This distribution corresponds to a wool top to be spun out in a metric count of 70. The weighted arithmetic average titer or fineness of the distribution is 15.6 microns and the medium fibers have titers between 13 and 18 microns. Thus, the titers of the medium fibers are grouped about the average titer of 15.6 microns and it will be seen that the medium titers are within a range of 6 microns of the average titer. The proportion of the medium fibers amounts to 67.8 percent by weight of the synthetic plastic fibers in the distribution, that is, to slightly more than two-thirds of the weight of the synthetic plastic fibers in the distribution. The coarser fibers have titers in the range of 19 to 30 microns and it may be seen that the titer of the coarsest fibers, that is, the fibers having a titer of 30 microns, differs from the average titer by less than 15 microns. The finer fibers have titers in the range of 7 to 12 microns and it may again be seen that the titer of the finest fibers, that is, the fibers having a titer of 7 microns, differs from the average titer by less than 15 microns. Other features of the present distribution, which are of secondary interest here, reside in that the range of titers of the medium fibers is less than 6 microns, the difference between the titer of the coarsest medium fibers and the coarsest fibers is 12 microns and the difference between the titer of the finest medium fibers and the finest fibers is less than 12 microns.

Figure 6:
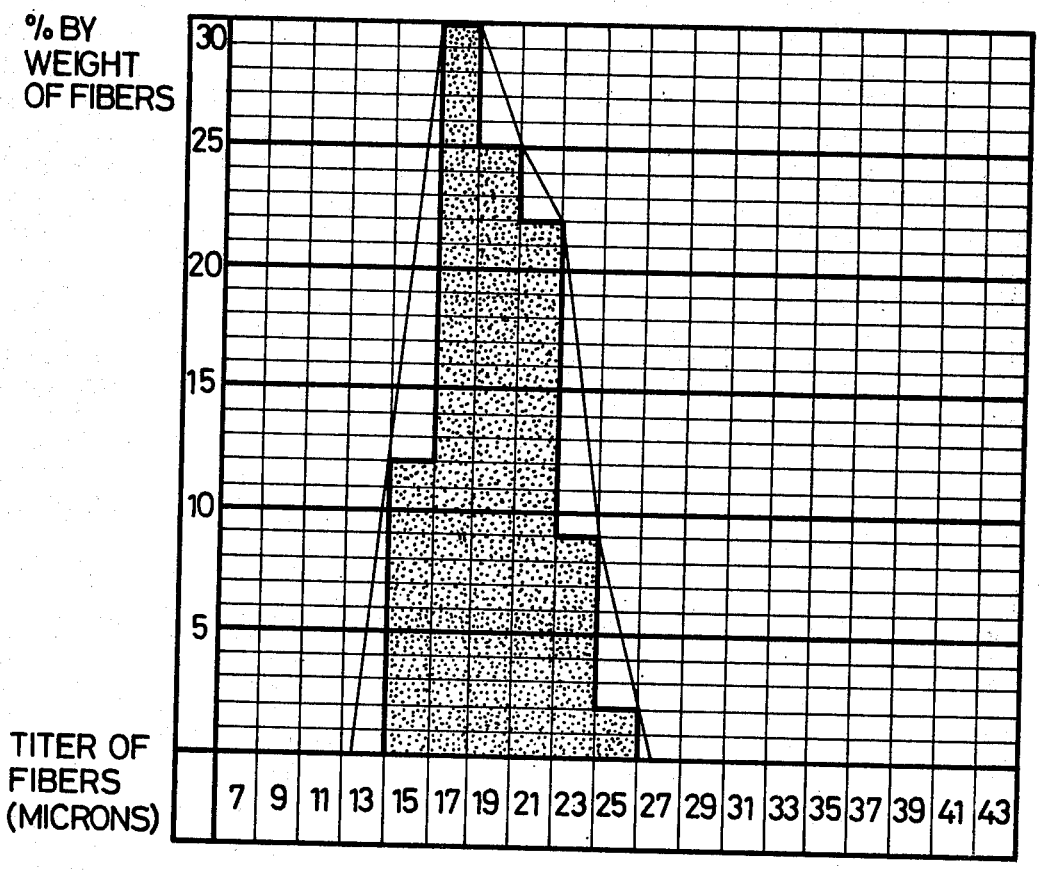

Referring now to FIG. 6, the following table sets forth the titer distribution shown therein:

| | | | |
|---|---|---|---|
| 15.5μ = | 12% | 20.15μ = | 22% |
| 17.5μ = | 30% | 22.75μ = | 9% |
| 19.0μ = | 25% | 24.9μ = | 2% |
| | | | 100% |

Here, the weighted arithmetic average titer or fineness of the synthetic plastic fibers in the distribution is 19.0 microns. The medium fibers have titers of 17.5 to 20.15 microns, and it may be seen that the titers of the medium fibers are again grouped about the average titer of 19.0 microns and deviate from this average titer by less than 6 microns. The proportion of the medium fibers amounts of 77 percent by weight of the fibers in the distribution and, hence, exceeds two-thirds of the weight of the fibers in the distribution. The coarser fibers have titers of 22.75 and 24.9 microns and it will be clear that the titer of the coarsest fibers is well within 15 microns of the average titer. The finer fibers have a titer of 15.5 microns which, again, is well within 15 microns of the average titer.

Figure 7:
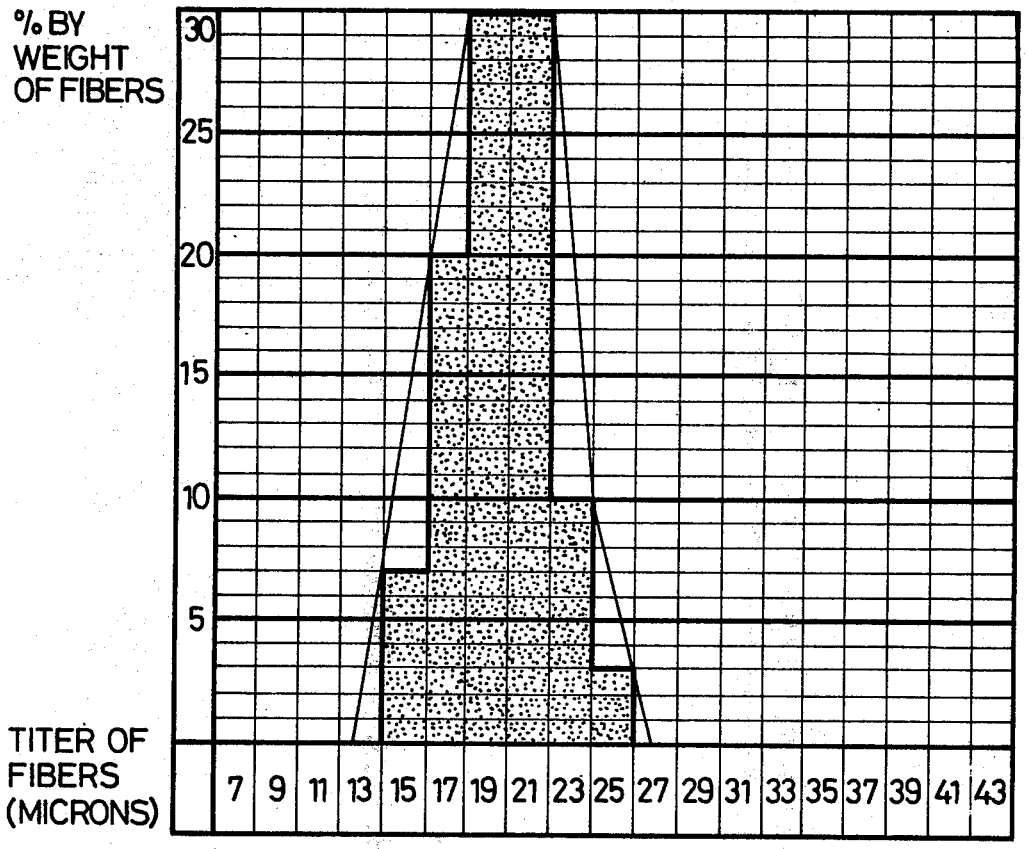

FIG. 7 illustrates yet another titer distribution in accordance with the invention and this distribution is tabulated below:

| | |
|---|---|
| 15.5μ = 7% | 20.15μ = 30% |
| 17.5μ = 20% | 22.75μ = 10% |
| 19.0μ = 30% | 24.9μ = 3% |
| | 100% |

The weighted arithmetic average titer or fineness of the synthetic plastic fibers in the distribution is here 19.6 microns. The medium fibers have titers of 17.5, 19.0 and 20.15 microns all of which lie within a range of 6 microns of the average titer. The proportion of the medium fibers amounts to 80 percent by weight of the fibers in the distribution which well exceeds two-thirds of the weight of the fibers in the distribution. The coarser fibers have titers of 22.75 and 24.9 microns and it is readily apparent that the titer of the coarsest fibers is within 15 microns of the average titer. The finer fibers have a titer of 15.5 microns which is also within 15 microns of the average titer.

Coming finally to FIG. 8, this illustrates yet another titer distribution according to the invention which is presented in the following table:

| | |
|---|---|
| 15.5μ = 5% | 20.15μ = 30% |
| 17.5μ = 15% | 22.75μ = 20% |
| 19.0μ = 25% | 24.9μ = 5% |
| | 100% |

In the above distribution, the weighted arithmetic average titer or fineness of the synethtic plastic fibers is 20.0 microns. Here, the medium fibers have titers of 19.0, 20.15 and 22.75 microns which, as will be clear, are all within a range of 6 microns of the average titer. The proportion of the medium fibers amounts to 75 percent by weight of the fibers in the distribution and, accordingly, to more than two-thirds of the weight of the fibers in the distribution. The coarser fibers have a titer of 24.9 microns which differs from the average titer by less than 15 microns. The finer fibers have titers of 15.5 and 17.5 microns and, as will be appreciated, the titer of the finest fibers is within 15 microns of the average titer.

The exemplary distributions of FIGS. 5–8 serve to illustrate that, as a rule of thumb, the titers of the medium fibers generally lie in the range of about 13 to 22.75 microns. However, this is not to imply that this will always be the case since some deviation to either side of this range may occur under some circumstances depending upon the total mixture which may be obtained in a particular instance with the fibers utilized. It is also interesting to note here that mixtures of the type illustrated in FIG. 5 approximate ideal conditions but that the mixing of fibers of twelve different titers (as is the case for FIG. 5) may pose difficulties in practice.

Figure 8:
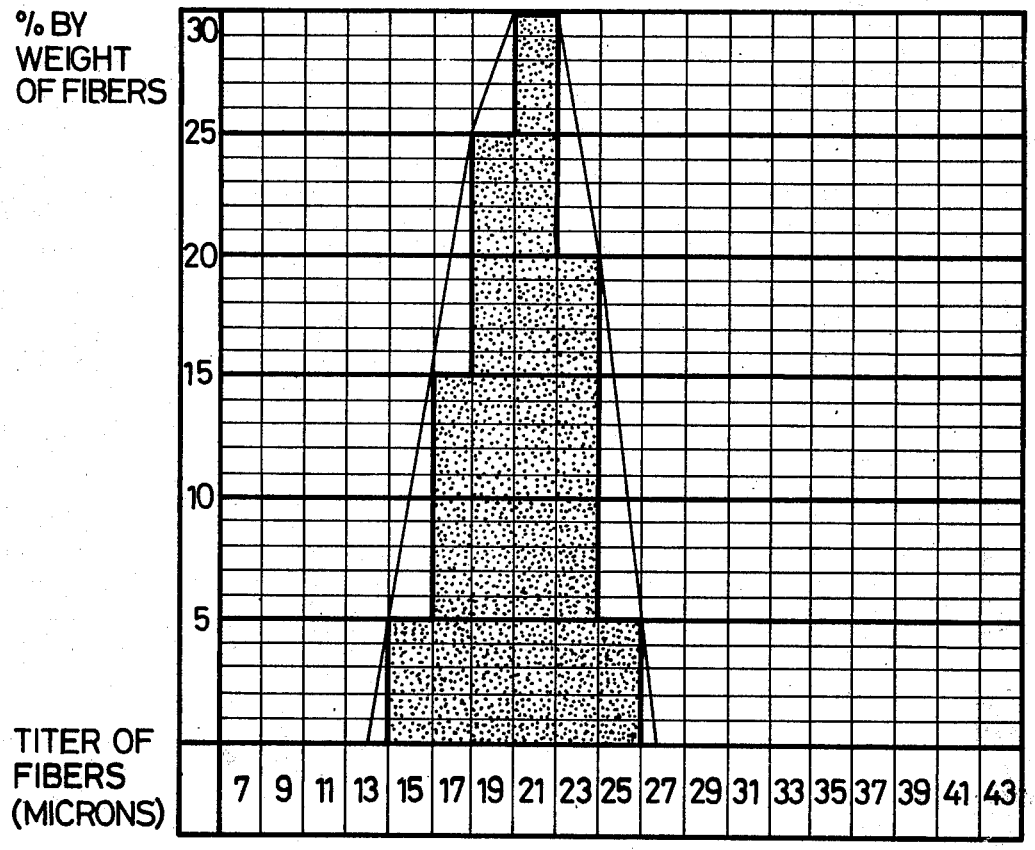

For this reason, mixtures of the type illustrated in FIGS. 6–8 represent more realistic distributions for practical applications.

Various synthetic fibers may be used for the invention. A few non-limiting examples of synthetic materials which are suitable for use in accordance with the invention are as follows: polyester, polyacrylonitrile (acrylix), polyamide, polypropylene.

As mentioned earlier, it is also possible to admix natural fibers (of vegetable or animal origin) with the synthetic plastic fibers in the production of a spun yarn according to the invention. For instance, the synthetic plastic fibers may be admixed with wool, cotton, flax (linen), ramie (bast) and/or cellulose (viscose). When making a spun yarn which includes both synthetic and natural fibers, it is not necessary for the natural fibers to be mixed in accordance with the titer distribution of the invention since they already exhibit such a titer distribution.

The following table gives some proportions, in weight percent, which are advantageously used when wool is admixed with synthetic fibers:

| synthetic fibers | wool |
|---|---|
| 55% | 45% |
| 70% | 30% |
| 80% | 20% |
| 88% | 12% |

Where synthetic fibers are admixed with cotton, the following proportions (in weight percent) are particularly favorable:

| synthetic fibers | cotton |
|---|---|
| 50% | 50% |
| 70% | 30% |

It will be understood that the foregoing proportions are merely exemplary and are in no way intended to limit the invention. However, it is noted here that the minimum proportion of synthetic fibers which is normally desirable to have and economically feasible to use when making a spun yarn by admixing synthetic and natural fibers is 55% by weight when the natural fibers are of wool and 50% by weight when the natural fibers are of cotton.

Examples of titer distributions for the synthetic plastic fibers of fiber mixes including natural fibers are given below. One of the examples relates to a synthetic fiberwool mix wherein the proportion, by weight, of synthetic fibers to wool is 55 : 45. The other example applies to either a synthetic fiber-wool mix or a synthetic fiber-cotton mix wherein the proportion, by weight, of synthetic fibers to natural fibers is 70 : 30. It is emphasized here that the titer distributions which follow apply to the synthetic fibers of the mixes.

| | synthetic fiber-wool mix (synthetic fibers, 55% by weight; wool 45% by weight) | synthetic fiber-wool or synthetic fiber-cotton mix (synthetic fibers, 70% by weight; natural fibers, 30% by weight) |
|---|---|---|
| 9–10μ | 0.11% | 0.14% |
| 11–12μ | 1.925% | 2.45% |
| 13–14μ | 4.125% | 5.25% |
| 15–16μ | 10.45% | 13.30% |
| 17–18μ | 15.235% | 19.39% |
| 19–20μ | 11.605% | 14.77% |

-continued

| | synthetic fiber-wool mix (synthetic fibers, 55% by weight; wool 45% by weight) | synthetic fiber-wool or synthetic fiber-cotton mix (synthetic fibers, 70% by weight; natural fibers, 30% by weight) |
|---|---|---|
| 21–22μ | 7.315% | 9.31% |
| 23–24μ | 1.87% | 2.38% |
| 25–26μ | 1.485% | 1.89% |
| 27–28μ | 0.495% | 0.63% |
| 29–30μ | 0.275% | 0.35% |
| 31–32μ | 0.11% | 0.14% |
| synthetic fibers | 55.000% | 70.00% |
| natural fibers | 45.000% | 30.00% |
| | 100.000% | 100.00% |

It will be clear that the percentages in the titer distribution are in relation to the respective mixtures as a whole. Moreover, it may be seen that the weight percent of the synthetic fibers increases with increasing titer towards the median value and decreases with increasing titer beyond the median value.

The production of a spun yarn according to the invention is accomplished by a simple, mechanical mixing process wherein temperature is of no particular significance. The length of time required for making a spun yarn in accordance with the invention is dependent upon the type of spinning machine or other suitable apparatus used and has no influence on the resulting product. Furthermore, it is not necessary to treat the individual fibers which are to form the spun yarn with any type of solution whatsoever. Also, the production of a spun yarn according to the invention is accomplished in the same manner regardless of whether synthetic fibers only are used or of whether synthetic fibers and natural fibers are used. It is further pointed out that, where the fiber mix includes synthetic fibers having different characteristics or qualities, it is only necessary that the titer distribution in accordance with the invention be satisfied for the mix as a whole. In other words, where the fiber mix includes synthetic fibers having different characteristics, the titer distribution of the invention need not be obeyed individually for each of the fibers having different characteristics.

Figure 9:
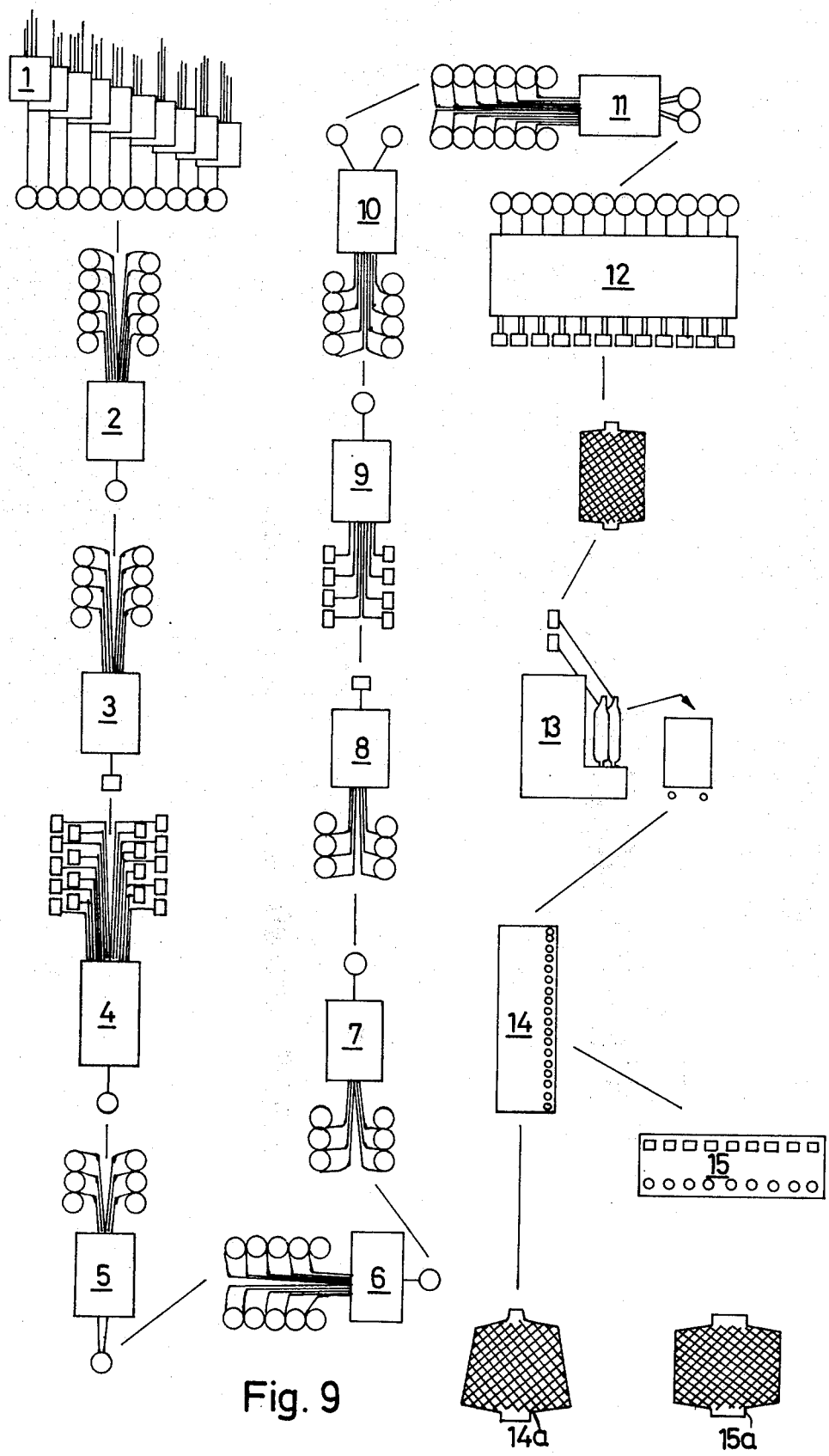
FIG. 9 is a flow diagram illustrating one method of making a spun yarn according to the invention.

FIG. 9 is a flow diagram illustrating one method of making spun yarns according to the invention. It may be seen that the exemplary method includes the steps 1–15a.

In step 1, endless synthetic tows of the different titers (deniers) required for producing spun yarn according to the invention are converted into converter slivers. This may be accomplished by subdividing the tows in a suitable manner, e.g. breaking or cutting the same, thereby forming slivers of desired length.

In step 2, the converter slivers are admitted into a first drawing or gilling passage.

In step 3, the converter slivers are admitted into a second drawing or gilling passage.

In step 4, the converter slivers are subjected to a mixing operation in a mixing gill passage (Melangeuse). Here, the converter slivers of different titer (denier) are mixed in accordance with the percentage of each titer (denier) required to obtain the desired count in the spun synthetic yarn.

In step 5, the mixture formed in step 4 is admitted into a first drawing or gilling passage subsequent to the mixing operation.

In step 6, the mixed converter slivers are combed. In other words, the pre-mixed converter slivers obtained in step 4 are transforemd into an intimately blended or mixed synthetic top which has been thoroughly freed from irregular bundles of fibers.

In step 7, the top formed in step 6 is admitted into a drawing passage for the purpose of obtaining an initial equalization of the intimately blended and combed synthetic top.

In step 8, the initially equalized top is admitted into an end-drawing passage in order to obtain a further equalization of the intimately blended or mixed top.

In step 9, the top is passed through a regulator frame constituting a first passage in preparation for further processing.

In steps 10 and 11, the top is further passed through two drawing frames which constitute weight reducing passages in preparation for subsequent processing.

In step 12, the top is conveyed through a roving passage (Finisseur).

In step 13, the top is conveyed to a ring-spinning frame.

In step 14, the spun yarn is wound up on a winding or coning frame and, at the same time, is electronically cleaned.

Step 14*a* indicates the wound up (coned) and electronically cleaned single spun yarn produced according to the flow diagram. This product of the spinning process may now be sold.

Step 15 indicates that the electronically cleaned, spun yarn may be twisted on a twisting frame.

Step 15*a* indicates the product of the twisting process or the twist, that is, the twisted (two-fold), electronically cleaned spun yarn obtained from step 15.

It will, of course, be appreciated that the flow diagram of FIG. 9 is merely illustrative and is not to be construed as limiting the invention.

Experiments have shown that spun yarn produced in accordance with the present invention will have a touch, that is, an effect on the skin of a person touching such materials, which is largely the same as that of the spun yarns made from natural fibers. By appropriately selecting the characteristics of the mix it is possible to produce spun yarns which have the characteristics and touch of spun yarns made from various types of wool, from cotton or other natural fibers of vegetable or animal origin, without — and this is an important consideration — having to accept any significant increase in the expense of producing such yarns.

This is important in view of the fact that many persons heretofore have found the wearing of garments made from spun yarns of synthetic plastic materials, or the contact with such spun yarns in other circumstances, unpleasant, a condition which can now be overcome.

It will be understood that each of the elements described above, or two or more together, may also find a useful application in other types of applications, differing from the types described above.

While the invention has been illustrated and described as embodied in a novel spun yarn, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. As a novel article of manufacture, a spun yarn at least predominantly made from synthetic plastic staple fibers and having the touch of a yarn approximating that of a yarn made only of natural fibers, said synthetic plastic staple fibers of said spun yarn comprising synthetic plastic staple fibers of at least three different titers including a medium titer which is within a range of about 6 microns of the average titer of the synthetic plastic fibers in said yarn, a fine titer which is at most about 15 microns less than said average titer and a coarse titer which is at most about 15 microns in excess of said average titer, said fibers of medium titer constituting a minimum of about two-thirds of the weight of the synthetic plastic fibers in said yarn.

2. An article as defined in claim 1, wherein said medium titer is from about 13 to about 22.75 microns.

3. An article as defined in claim 1, wherein the fibers of different titer have different staple lengths.

4. An article as defined in claim 1, wherein some of said fibers have different characteristics than other of said fibers.

5. An article as defined in claim 1; and further comprising natural fibers in combination with said synthetic plastic fibers.

6. An article as defined in claim 5, wherein said natural fibers are of plant origin.

7. An article as defined in claim 5, wherein said natural fibers are of animal origin.

* * * * *